US007999475B2

(12) United States Patent
Ishikawa et al.

(10) Patent No.: US 7,999,475 B2
(45) Date of Patent: Aug. 16, 2011

(54) SHORT ARC TYPE DISCHARGE LAMP

(75) Inventors: Hirohisa Ishikawa, Hyogo (JP); Toyohiko Kumada, Hyogo (JP); Nobuhiro Nagamachi, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 95 days.

(21) Appl. No.: 12/591,097

(22) Filed: Nov. 9, 2009

(65) Prior Publication Data

US 2010/0156293 A1 Jun. 24, 2010

(30) Foreign Application Priority Data

Dec. 19, 2008 (JP) ..... 2008-323179

(51) Int. Cl.
*H01J 17/04* (2006.01)

(52) U.S. Cl. ..... 313/631; 313/491

(58) Field of Classification Search ..... 313/631, 313/491

See application file for complete search history.

(56) References Cited

U.S. PATENT DOCUMENTS

2008/0315771 A1 12/2008 Tsukamoto et al.
2009/0195158 A1* 8/2009 Nagamachi et al. ..... 313/631

FOREIGN PATENT DOCUMENTS

JP 2008-282554 A 11/2008
JP 2010218724 A * 9/2010

* cited by examiner

*Primary Examiner* — Vip Patel
(74) *Attorney, Agent, or Firm* — Rader, Fishman & Grauer PLLC

(57) ABSTRACT

A short arc type discharge lamp has a pair of electrodes, at least one of which has an electrode body and an axis part. A taper part is formed at a base side of the electrode body. Plural holes extending in an axis direction of the electrode in line are formed at the taper part.

2 Claims, 5 Drawing Sheets

SHORT ARC TYPE DISCHARGE LAMP

CROSS-REFERENCES TO RELATED APPLICATION

This application claims priority from Japanese Patent Application Serial No. 2008-323179 filed Dec. 19, 2008, the content of which is incorporated herein by reference in its entirety.

TECHNICAL FIELD

The present invention relates to a short arc type discharge lamp, more particularly used as a light source for a projector apparatus, such as a liquid crystal display apparatus or a DLP (digital light processor) apparatus using a DMD (digital mirror device) etc.

BACKGROUND

A projector apparatus requires uniform image illumination with sufficient color rendering properties to a rectangle screen. Therefore, a lamp in which 0.15 mg/mm$^3$ or more of mercury is enclosed so as to obtain high mercury vapor pressure is used as a light source. Such a lamp is disclosed in Japanese laid open patent No. 2008-282554.

Recently, a device increases the applied electric power to the lamp and the operating gas-pressure by increasing mercury quantity is increased, for high output. As a result, the temperature of the electrode during operation is progressively increased. As a crystal grain of an electrode consisting of tungsten is grown the boundaries between crystal grains tends to decrease.

In this way, when the number of crystal grain boundaries is decreased, the electrode is broken by outside vibrations. Furthermore, in the lamp of alternative current operating, the electrode is easily broken because the electrode vibrates intensely by intense of the polarity inversion.

SUMMARY

An object of the present invention is to offer a short arc type high-pressure discharge lamp which has high-strength properties, high reliability, and a long economic life.

BRIEF DESCRIPTION OF DRAWINGS

Other features and advantages of the present short arc type high-pressure discharge lamp will be apparent from the ensuing description, taken in conjunction with the accompanying drawings, in which.

DETAILED DESCRIPTION

A description of embodiment of the present short arc type discharge lamp will now be given below, referring to drawings. While the claims are not limited to such embodiments, an appreciation of various aspects of the present short arc type discharge lamp are best gained through a discussion of various examples thereof.

Figure 1:
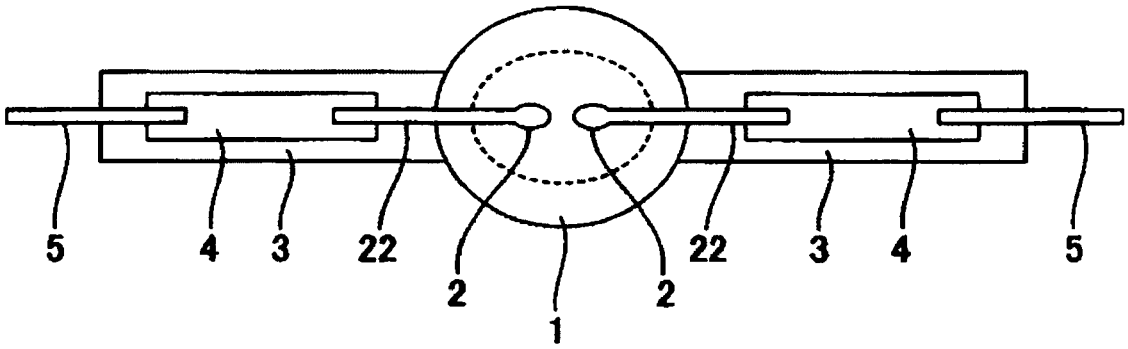
FIG. 1 shows a schematic structure of a short arc type discharge lamp according to the present invention.

FIG. 1 shows the schematic structure of a short arc type discharge lamp according to the present invention. A discharge lamp as shown in FIG. 1 has an emitting bulb 1 with an approximately spherical shape. A pair of electrodes 2 are arranged so as to face each other in the emitting bulb 1. Sealing portions 3 are formed at both ends of the emitting bulb 1 so as to extend from the emitting bulb 1. Metallic foils 4 for electric conduction made of molybdenum are air-tightly sealed in the respective sealing portions 3, for example shrink sealing. The axis portion of the electrode 2 is electrically connected to the one side of the metallic foil 4. An external lead 5 is connected to the other side of the metallic foil 4 and is projected from the sealing portion 3 to the outside. In the above mentioned short arc type discharge lamp, both electrodes 2 are fed through the metallic foil 4 and the external lead 5, and the operating is carried out with alternating current.

Mercury, rare gas, and halogen gas are enclosed in the emitting bulb 1. The mercury whose amount is 0.15 mg/mm$^3$ or more is enclosed in the emitting bulb 1 to obtain radiation light having the required visible light wavelength of, for example, 360-780 nm. Although depending on temperature conditions of the emitting bulb 1, the vapor pressure thereof becomes extremely high at time of operating, that is, 150 or more atmospheric pressure. Moreover, by enclosing more mercury, it is possible to make a discharge lamp whose mercury vapor pressure is higher at time of operating, such as 200 or more atmospheric pressure or 300 or more atmospheric pressure. The higher the mercury vapor pressure becomes, the more a light source for a projector apparatus is suitably realized. Argon gas as rare gas whose amount is, for example, 13 kPa is enclosed in the emitting bulb 1, so as to improve the operating starting nature. The halogen gas, such as iodine, bromine, chlorine, etc. is enclosed in form of a compound with mercury or other metals to obtain long-life attributed to the halogen cycle. The amount of enclosed halogen is chosen in a range of $10^{-6}$ to $10^{-2}$ μmol/mm$^3$.

An example of the discharge lamp will be given below. For example, the maximum outer diameter of the emitting bulb is 9.5 mm., a distance between both electrodes is 1.5 mm, an inner volume of the discharge space is 75 mm$^3$, rated voltage is 80 V, and rated power is 150 W and operation is carried out with alternating current. Moreover, since the short arc type discharge lamp used for a projector apparatus is extremely miniaturized, thermal influence in the discharge space becomes very severe. For example, the lamp tube wall load value is set to 0.8-2.0 W/mm$^2$, and minimum distance from inner face of the emitting bulb to electrode is normally equal to or less than 2 mm, for example less than 1.5 mm and less than 1.0 mm.

Figure 2A:
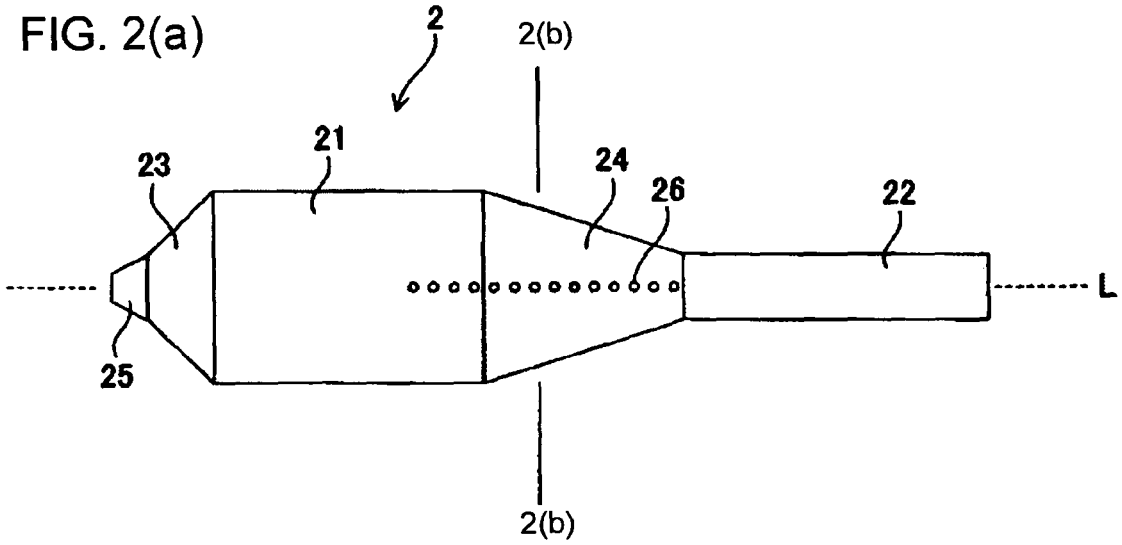
FIGS. 2(*a*) and 2(*b*) show a partial structure of an electrode of a short arc type discharge lamp according to the present invention.
Figure 2B:
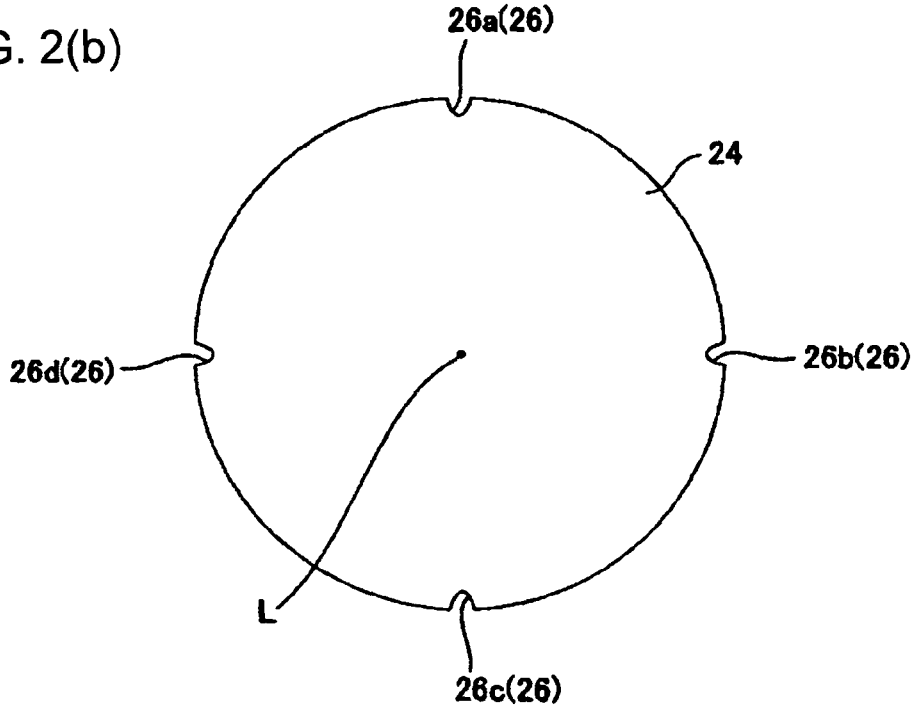

FIGS. 2(*a*) and 2(*b*) show one embodiment of electrode of the short arc type discharge lamp according to the present invention. FIG. 2(*a*) is a plan view of the electrode, and FIG. 2(*b*) is a cross-sectional view along line 2(*b*)-2(*b*) shown in FIG. 2(*a*). The electrode 2 comprises an electrode body 21 and an axis part 22 having a smaller outer diameter than an outer diameter of the electrode body 21. A taper part 23 whose outer diameter gradually reduces from the electrode body 21, is formed at the tips side of the electrode body 21 A projection part 25 is formed at tip of the taper part 23. A taper part 24 whose outer diameter gradually reduces, is formed at base side of the electrode body 21. The end part of the taper part 24 is connected to the axis part 22.

The electrode body 21, the axis part 22, the taper part 23, the taper part 24 and the projection part 25 are physically formed of a single member. For example, they are made from one wire rod made of tungsten by metal removal machining. The electrode body 21, the axis body 22, the taper part 23, the taper part 24 and the projection part 25 are made of a high purity tungsten material, especially a desirable tungsten material purity of more than 5N (99.999%).

The taper part 23 formed the tip side of electrode body 21 is circular truncated cone shape as a whole. The outer diameter of the base side of the taper part 23 is equal to the diameter of electrode body 21. A shape of the projection part 25 is a circular truncated cone shape or a column shape. The projection part 25 is positioned where arc's highest temperature area is formed. The projection part 25 is able to be formed by same member as the taper part 23. But it is produced naturally with progress of operating time in case of the lamp enclosed halogen gas. The taper part 24 formed at the base side of the electrode body 21 is a circular truncated cone shape as a whole. The outer diameter of the tip side of the taper part 24 is equal to outer diameter of the electrode body 21, and outer diameter of base side of the taper part 24 is equal to outer diameter of the axis part 22.

As shown FIGS. 2(*a*) and 2(*b*), plural holes 26 are formed in line along axis L at the taper part 24. According to the embodiment of the drawing, holes 26 are at the taper part 24 and the part of the electrode body 21. Each hole 26 is, as shown FIG. 2(*b*), formed radially as line L of the electrode is center axis. Each bottom part of each hole is formed inside of electrode.

An example of specification of the electrode will be given below. For example, the outer diameter of the electrode body 21 is 1.8 mm, the length thereof in the axis direction is 2.5 mm, the length in the axis direction of the taper part 23 is 0.5 mm, the length in the axis direction of the taper part 24 is 1.0 mm, outer diameter of the axis part 22 is 0.5 mm, and the length in the axis direction of the axis part 22 is 5.0 mm. A shape of the hole 26 is concave hemisphere, and a diameter thereof is 30-100 μm and a depth thereof is 50-800 μm. An interval between central points of holes next to each other is less than 3 times of the diameter of the hole. These holes 26 are formed with a line along an axis L.

Figure 3A:
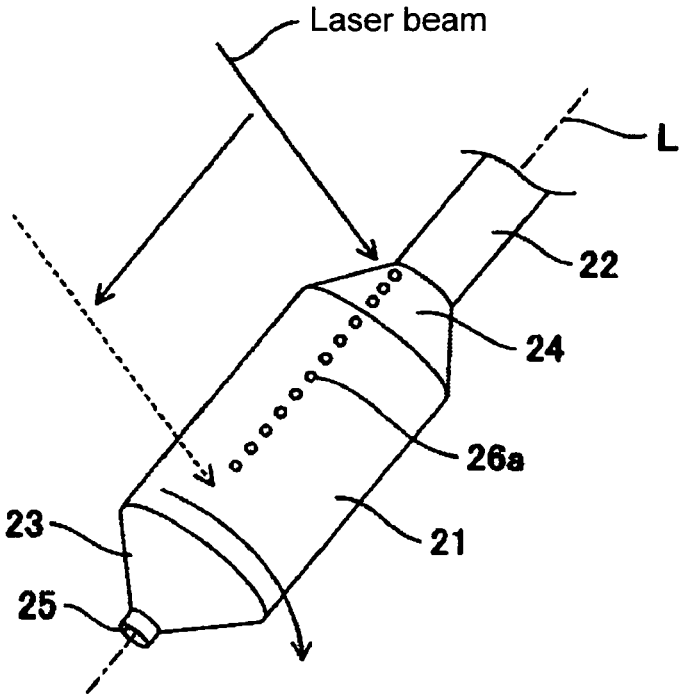
FIGS. 3(*a*) and 3(*b*) show a perspective view of a manufacturing method of a hole formed by an electrode according to the present invention.
Figure 3B:
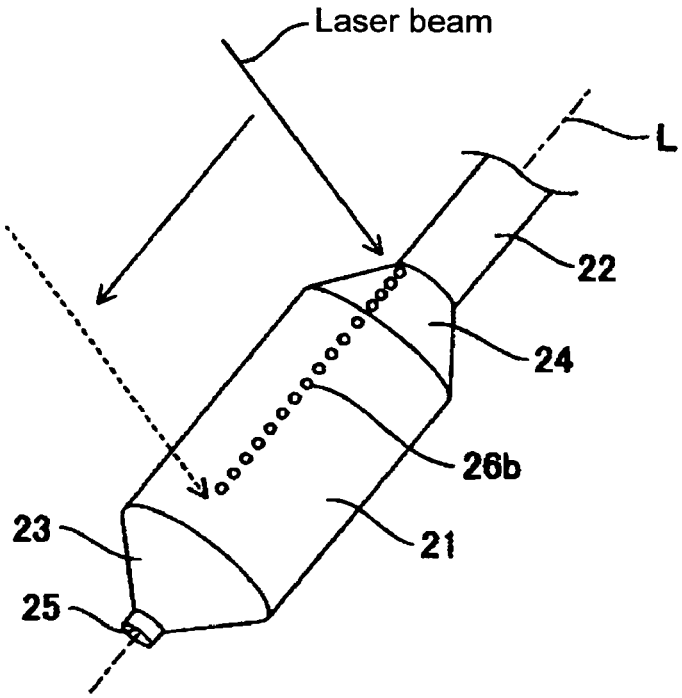

The holes 26 are formed by irradiating laser beam. A manufacturing method of the holes 26 will be explained as following using FIGS. 3(*a*) and 3(*b*). As shown FIG. 3(*a*), a series of holes 26*a* are formed at the taper part 24 and the electrode body 21 by scanning with pulsed laser beam along the axis L. After forming holes 26*a*, the electrode body 21 is rotated at a predetermined angle, for example 90° and as shown FIG. 3(*b*), a series of holes 26*b* are formed by scanning with pulsed laser beam along the axis L. Furthermore, by repeating the same procedure, a series of holes 26*c* and a series of holes 26*d* are formed sequentially. The holes 26*a*, 26*b*, 26*c*, 26*d* are necessary in the taper part 24, but not in the electrode body 21.

The condition of laser beam is selected so that the depth of the holes 26 is 50-800 μm. Concretely, a frequency is 20 kHz, an average output is 8 w, an irradiated time per one hole is 0.1-1.0 second, and a wavelength is 1064 nm.

In the electrode 2 made by the above method, a crystal grain grows remarkably during operating. But the crystal grains are inhibited from growing in a direction perpendicular to the axis L, because plural holes 26 are formed in line along the axis. Therefore, the growth direction of the crystal agrees in the axis L by the plural holes 26. The crystal grains grow while being engaged with each other in the direction of the axis L, but is inhibited form growing by the hole in the direction perpendicular to the axis L. As a result, the crystal grain boundary does not become a big size in the direction perpendicular to the axis of the electrode. Furthermore, the electrode according to the present invention is hard to break.

Figure 4A:
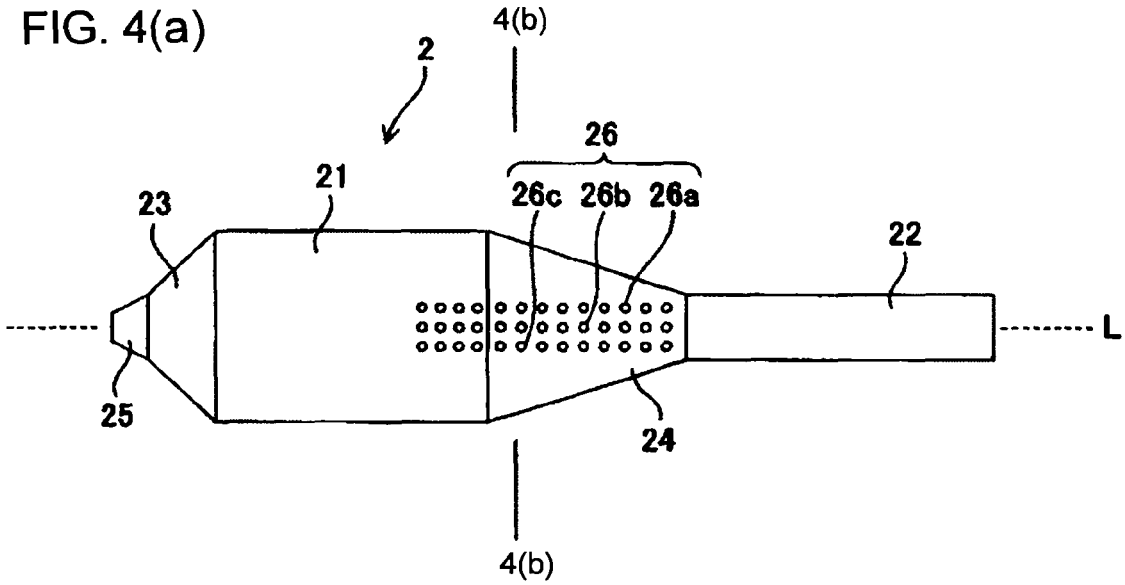
FIGS. 4(*a*) and 4(*b*) show a partial structure of an electrode of a short arc type discharge lamp shown as the other embodiment according to the present invention.
Figure 4B:
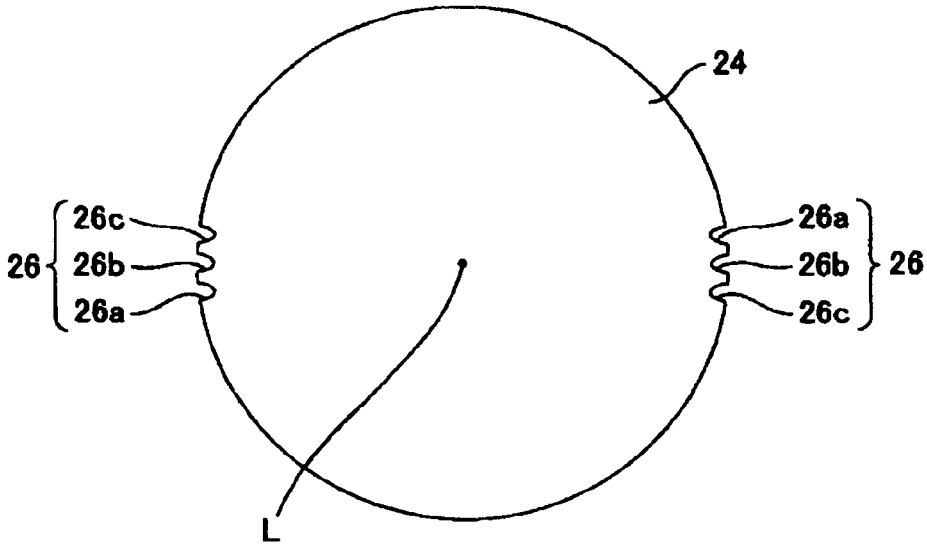

FIGS. 4(*a*) and 4(*b*) show the other embodiment of an electrode of the short arc type discharge lamp according to the present invention. FIG. 4(*a*) is a plan view of the electrode, and FIG. 4(*b*) is a cross-sectional view along line 4(*b*)-4(*b*) shown in FIG. 4(*a*). The electrode 2 has a taper part 24 at base side of the electrode body 21, and an outer diameter of the taper part 24 that gradually reduces. The taper part 24 is connected to the axis part 22.

As shown FIG. 4, plural holes 26 are formed in line along an axis L at the taper part 24. According to the embodiment of the drawing, holes 26 are at the taper part 24 and the part of the electrode body 21. Concretely, the plural holes 26*a* are straightly formed in line along the axis L of the electrode, the plural holes 26*b* are straightly formed along the axis L and next to the line of the plural holes 26*a*, and the plural holes 26*c* are straightly formed along the axis L and next to the line of the plural holes 26*b*. Therefore, a belt-shaped holes-area consisting of the holes 26*a*, the holes 26*b* and the holes 26*c*, is formed at the taper part 24 and electrode body 21. The holes 26*a*, the holes 26*b* and the holes 26*c* are necessary in the taper part 26, but not in the electrode body 21.

As shown FIG. 4(*b*), each hole 26 is symmetric with respect to the central axis of the electrode. The bottom of each hole 26 extends to the inside of the electrode.

Figure 5A:
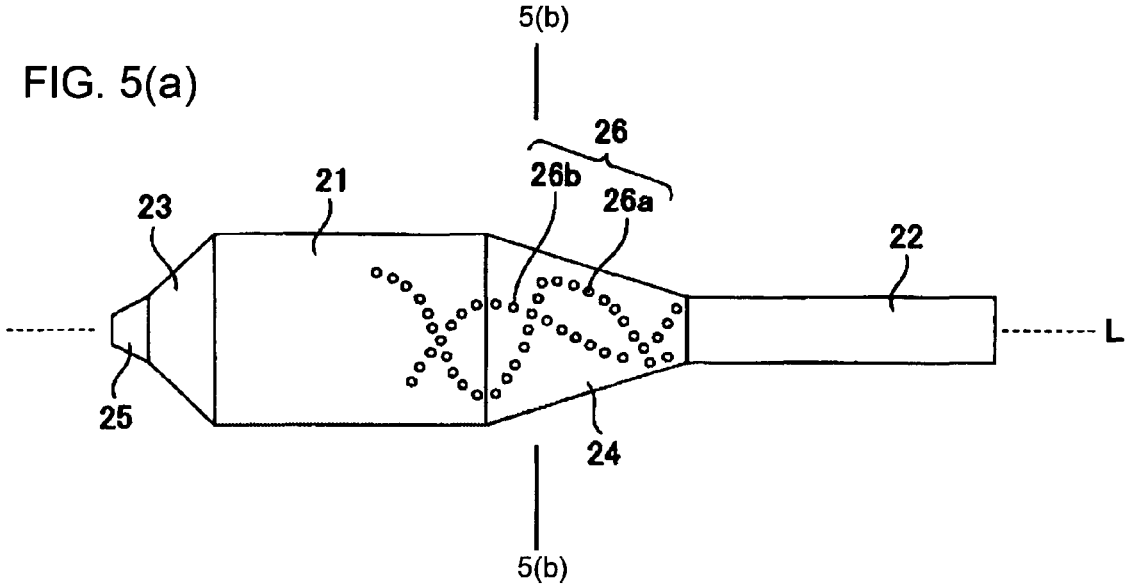
FIGS. 5(*a*) and 5(*b*) show a partial structure of an electrode of a short arc type discharge lamp shown as the other embodiment according to the present invention.
Figure 5B:
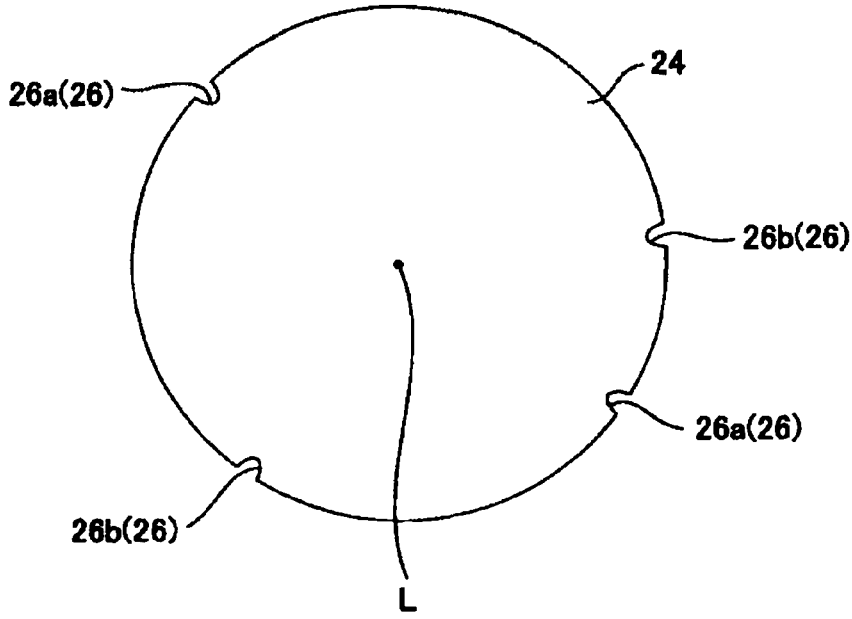

FIGS. 5(*a*) and 5(*b*) show the other embodiment of electrode of the short arc type discharge lamp according to the present invention. FIG. 5(*a*) is a plan view of the electrode, and FIG. 5(*b*) is a cross-sectional view along line 5(*b*)-5(*b*) shown in FIG. 5(*a*). The electrode 2 has a taper part 24 at base side of the electrode body 21, and an outer diameter of the taper part 24 gradually reduces. The taper part 24 is connected to the axis part 24.

As shown in FIGS. 5(*a*) and 5(*b*), a plurality of holes 26 are formed in the direction of axis L at the taper part 24. According to the embodiment of the drawing, holes 26 are at the taper part 24 and the part of the electrode body 21. Concretely, the plural holes 26*a* are curved-shapely formed in direction of the axis L of the electrode, the plural holes 26*b* are also curved-shapely formed in direction of the axis L of the electrode. Therefore, the holes 26*a* and the holes 26*b* are irregularly formed at the taper part 24 and electrode body 21. The holes 26*a* and the holes 26*b* are necessary in the taper part 26, but not in the electrode body 21.

As shown in FIG. 5(*b*), each hole 26 is irregularly formed with respect to the central axis of the electrode. The bottom of each hole 26 extends to the central axis.

The electrode as shown in FIGS. 4(*a*)(*b*) and FIGS. 5(*a*)(*b*), have plural holes 26 in line along to the axis L in the taper part 24, same as the electrode of FIGS. 2(*a*)(*b*). Therefore, the crystal grains are inhibited from growing in a direction perpendicular to the axis L, because plural holes 26 are formed in line along the axis L. Therefore, the growth direction of the crystal agrees with the axis L by the plural holes 26. The crystal grains grow while being engaged with each other in the direction of the axis L, but are inhibited from growing by the hole in the direction perpendicular to the axis L. As a result, the crystal grain boundary does not become a big size in the direction perpendicular to the axis of the electrode. Furthermore, the electrode according to the present invention is hard to break.

The electrode as shown FIGS. 2(*a*)(*b*), FIGS. 4(*a*)(*b*) and FIGS. 5(*a*)(*b*), is made of the tungsten having a purity of 99.999 wt. % or higher and has limited impurities. Therefore, the electrode can be prevented from failing in strength.

According to the short arc type discharge lamp, it is possible to prevent the electrode from being broken, to raise reliability and lamp life.

What is claimed is:

1. A short arc type discharge lamp comprising:

a pair of electrodes, at least one of the electrodes has an electrode body and an axis part, wherein a taper part is formed at a base side of the electrode body, and a plurality of holes extending in an axis direction of the electrode in line are formed at the taper part.

2. The short arc type discharge lamp according to claim 1, wherein the at least one of the electrodes is made of tungsten having 99.999% or more of purity.

* * * * *